US005564169A

United States Patent [19]

Willauer, Jr.

[11] Patent Number: 5,564,169

[45] Date of Patent: Oct. 15, 1996

[54] METHOD AND APPARATUS FOR OPTICALLY SIMULATING MOIRE FABRIC

[75] Inventor: Howard C. Willauer, Jr., Spartanburg, S.C.

[73] Assignee: Milliken Research Corporation, Spartanburg, S.C.

[21] Appl. No.: 162,640

[22] Filed: Dec. 3, 1993

[51] Int. Cl.[6] ..... D06C 23/04

[52] U.S. Cl. ..... 26/70; 26/69 R; 33/1 BB

[58] Field of Search ..... 26/1, 69 R, 70; 28/163, 299; 33/1 B, 1 BB, 1 C, 1 LE, 1 CF, 485

[56] References Cited

U.S. PATENT DOCUMENTS

| | | | |
|---|---|---|---|
| 121,128 | 11/1871 | Rehn | 33/1 B |
| 830,282 | 9/1906 | Andrews | 33/1 B |
| 1,831,536 | 11/1931 | Luhn | 356/242 |
| 1,852,674 | 4/1932 | Pons | 26/70 |
| 1,910,219 | 5/1933 | Hopkins et al. | 28/299 |
| 2,701,980 | 2/1955 | Abbott . | |
| 2,747,795 | 5/1956 | Kreuttner | 33/1 B |
| 3,269,032 | 8/1966 | Sumner | 28/299 |
| 3,377,707 | 4/1968 | Breese | 33/1 B |
| 3,388,441 | 6/1968 | Snyder | 28/299 |
| 3,890,715 | 6/1975 | Kaplan | 33/1 B |
| 3,945,129 | 3/1976 | Bergkvist | 33/348 |
| 4,021,893 | 5/1977 | See et al. | 26/70 |
| 4,466,192 | 8/1984 | Ager | 33/1 B |
| 4,475,288 | 10/1984 | Pellegrom | 33/1 B |
| 4,559,705 | 12/1985 | Hodge et al. | 33/1 B |
| 4,663,850 | 5/1987 | Kareko et al. | 33/1 B |
| 4,779,346 | 10/1988 | Schafer | 33/1 B |

FOREIGN PATENT DOCUMENTS

| | | | |
|---|---|---|---|
| 402277873 | 11/1990 | Japan | 26/70 |
| 0673108 | 2/1990 | Switzerland | 33/1 B |

*Primary Examiner*—Amy B. Vanatta

*Attorney, Agent, or Firm*—Kevin M. Kercher; Terry Moyer

[57] ABSTRACT

A method and apparatus for simulating an appearance of a moiré fabric on a textile fabric having a number of filling yarns per inch utilizing a substantially transparent sheet having a number of lines per inch which substantially corresponds to said number of filling yarns per inch in the textile fabric to be viewed. The lines are aligned substantially parallel to the filling yarns of the textile fabric thereby simulating the appearance of a moiré fabric. When the textile fabric has a lateral shifting of the filling yarns, then the lines on the substantially transparent sheet are straight and if the filling yarns of the textile fabric are not yet shifted, then the lines on the substantially transparent sheet are curved in accordance with the proposed filling yarn shift.

10 Claims, 2 Drawing Sheets

METHOD AND APPARATUS FOR OPTICALLY SIMULATING MOIRE FABRIC

BACKGROUND OF THE INVENTION

This invention relates to a method and apparatus for optically simulating moiré fabric. Moiré fabrics are defined as a wavy or watered effect on textile fabric, especially a corded fabric of silk, rayon or one of the manufactured fibers. An excellent example of a corded fabric would a faille. Failles are generally defined as having fine, bright continuous filament warp yarns, course spun filling yarns, and a plain weave. This creates a noticeable ribbed effect in the filling direction. Other fabrics can be utilized with typically inferior results, however, a visible ribbed effect should be present in the fabric's filling.

Moiré fabric falls into one of two categories. The first is an uncontrolled moiré when the filling ribs of one layer of fabric are intentionally skewed with respect to the second layer of fabric prior to applying pressure to both layers of fabric. This will result in a significant increase in the number of filling ribs that cross with the associated increase of vertical moiré lines. This type of moiré fabric is very inconsistent and results vary from batch to batch.

The second category of moiré fabric is controlled moiré fabric. There are a large number of ways to create controlled moiré fabric. This is done by selectively distorting or skewing small portions of the filling ribs so that the filling ribs only cross in selective areas. The most common method is the Francais bar method in which ribbed, woven fabric is dragged over a stationery bar, which has a series of knobs that are spaced at desired intervals. This is performed at very high tension. The knobs distort the filling into a bow wherever they touch the fabric. When two pieces of this fabric are subjected to pressure, a traditional controlled moiré will result that is typically found in upholstery, drapery, apparel, and other end uses. This type of moiré patterning is repeatedly fixed and dragging under high tension can damage and destroy the fabric.

Another method utilized in creating controlled moiré fabric is the "scratch" method. The "scratch" method is accomplished by means of a resilient roll having the desired designs embossed thereon. These designs may include flowers, geometrics, and so forth. While the fabric is in contact with this embossed roll, it is "scratched" with a series of steel blades which distort the filling yarns of the fabric according to the pattern that is embossed on the roll. Upon applying pressure to two pieces of this treated fabric, a moiré pattern is produced. There is destruction or damage to the yarns by the steel blades and there is also a fixedly repeatable pattern. This "scratch" method produces very poor results with a large number of broken filaments. The blades actually only contact the warp yarns, thus producing a large amount of broken filaments with only a minimal movement of the filling yarn. Of course, the movement of the filling yarn is the desired result. Furthermore, by examination of faille fabric, the filling is virtually covered by warp yarns and, thus, is very difficult to move the filling by mechanical means. Furthermore, this "scratch" method creates fuzz on the surface of the fabric that results in less shine and poor moiré patterns.

Yet another traditional method of producing a controlled moiré is found in U.S. Pat. No. 2,448,145, which discloses the selective application of water to fabric with a noticeable ribbed effect in the filling direction. The fabric is then placed under high tension and then dried. This will distort the filling yarns in the wet areas differently from the filling yarns in the dry areas. Again, pressure is applied to two pieces of this treated fabric and a moiré pattern is produced. A severe problem with this technology is that it is very difficult to wet yarns selectively while leaving adjacent yarns dry for a precise pattern. Furthermore, stretching under high tension can severely weaken or destroy filling yarns. This method is deficient since it only works on fibers that absorb large amounts of water such as cotton, silk, and so forth. Each pattern requires a specific patterning roll or screen which only changes the pick count slightly in the areas treated with water. While this may produce some beating when the fabrics are sandwiched and calendered, it does not produce a true moiré pattern because the filling is not distorted with bow or skew.

Another method of creating moiré fabric is by directing at least one stream of pressurized heated gas or at least one laser beam at the surface of a first piece of fabric and selectively interrupting and re-establishing contact between said gas stream or laser beam and said surface in accordance with pattern information to pattern the fabric. This is followed by combining the patterned piece of fabric with an unpatterned piece of fabric and applying pressure by means of calender rolls having smooth surfaces to said combination of the first piece of patterned fabric and second piece of unpatterned fabric. The laser beam or heated gas shifts the filling yarns in the fabric.

Another means of creating moiré fabric is by placing a first piece of fabric against the support member and directing at least one stream of fluid at the surface of said first piece of fabric to provide lateral filling yarn displacement. The stream is delivered at a peak dynamic pressure in excess of about 300 p.s.i.g. and less than 4000 p.s.i.g. while selectively interrupting and re-establishing contact between said stream and said surface in accordance with pattern information in order to pattern said first piece of fabric. This is followed by combining said patterned first piece of fabric and unpatterned second piece of fabric in overlapping relationship and applying pressure by means of calender rolls having smooth surfaces to said combination of said first piece of patterned fabric and said second piece of unpatterned fabric. It has been found that by using high pressure liquid jets that the moment of force in the plane of the fabric that will result in the movement of filling yarns in the fabric can do so without damage to the warp yarns.

In summary, there are a large number of means of creating moiré fabric, however, they all require considerable expenditure of time and money in order to develop the pattern. It would be extremely valuable to ascertain the moiré pattern either prior to the processing step or the secondary calendering step so that the fabric does not need to be destroyed if the results are not as desired.

The present invention solves this problem in a manner not disclosed in the known prior art.

SUMMARY OF THE INVENTION

A method and apparatus for simulating an appearance of a moiré fabric on a textile fabric having a number of filling yarns per inch utilizing a substantially transparent sheet having a number of lines per inch which substantially corresponds to said number of filling yarns per inch in said textile fabric to be viewed, and said lines are aligned substantially parallel to said filling yarns thereby simulating the appearance of moiré fabric. When the textile fabric has a lateral shifting of the filling yarns, then the lines on the substantially transparent sheet are straight and if the filling yarns of the textile fabric are not yet shifted, then the lines on the substantially transparent sheet are curved in accordance with the proposed filling yarn shift.

The advantage of this invention is to be able to simulate a wide variety of moiré patterns prior to any lateral shifting of the filling yarns within a fabric.

Another advantage of this invention is to simulate a moiré fabric utilizing fabric having shifted fill yarns prior to any treatment under pressure including calender rolls, high pressure rotary presses, platen presses, and so forth.

These and other advantages will be in part apparent and in part pointed out below.

BRIEF DESCRIPTION OF THE DRAWINGS

The above, as well as other objects of the invention, will become more apparent from the following detailed description of the preferred embodiments of the invention when taken together with the accompanying drawings, in which.

Corresponding reference characters indicate corresponding parts throughout the several views of the drawings.

DETAILED DESCRIPTION OF THE PREFERRED EMBODIMENT

Figure 1:
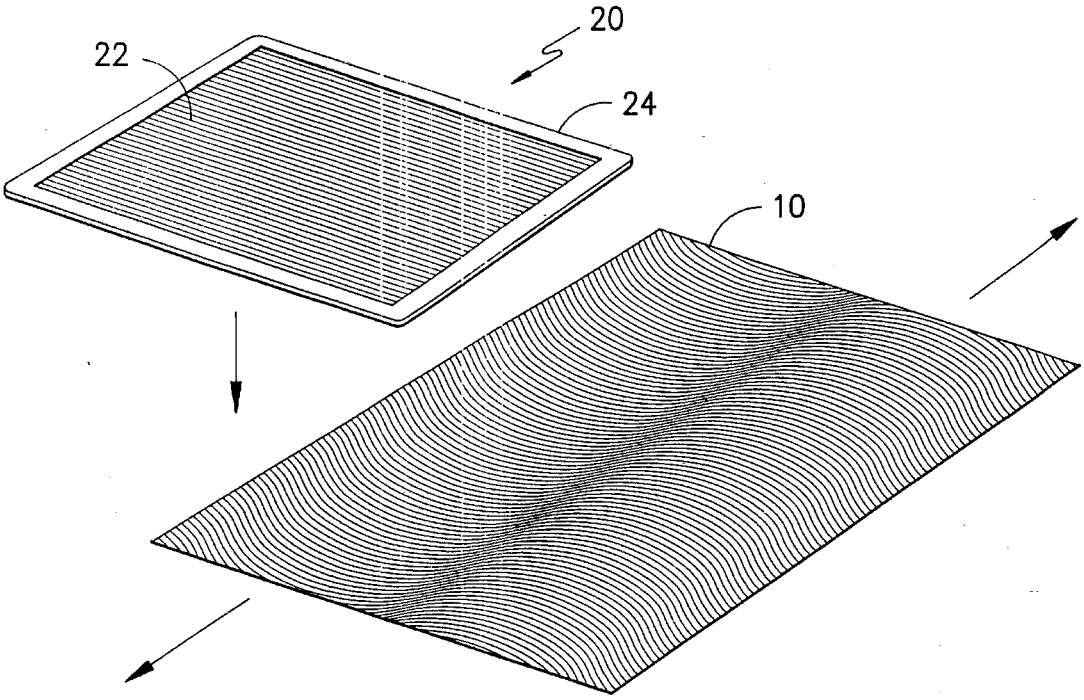
FIG. 1 is a perspective view of an apparatus for simulating the appearance of a moiré pattern as well as a piece of fabric in which the filling yarns have been laterally shifted.

Referring now to the accompanying drawings, and initially to FIG. 1, which shows a perspective view of a piece of fabric denoted by numeral 10 in which the filling yarns have been laterally shifted. There are numerous ways of laterally shifting filling yarns in fabric in a controlled manner. One common method is the Francais bar method in which ribbed, woven fabric is dragged over a stationery bar, which has a series of knobs that are spaced at desired intervals. This is performed at very high tension. The knobs distort the filling into a bow wherever they touch the fabric. When two pieces of fabric are subjected to pressure, a traditional controlled moiré will result that is typically found in upholstery, drapery, apparel and other end uses. Another method is called the "scratch" method. This is accomplished by means of a resilient roll having the desired designs embossed thereon. Designs may include flowers, geometrics, and so forth. While the fabric in contact with this embossed roll, it is scratched with a series of steel blades which distort the filling yarns of the fabric according to the pattern that is embossed on the roll. Upon applying pressure to two pieces of this treated fabric, a moiré pattern is produced. Again, there is the problem of destruction or damage to the yarns by the steel blades and a fixedly, repeatable pattern. This "scratch" method has very poor results with a large quantity of broken filaments. The blades actually only contact the warp yarns, thus producing a large amount of broken filaments with only a minimal movement of the filling yarn. It is the movement of the filling yarn, of course, which is desired.

Another traditional method of producing a controlled moiré is that found in U.S. Pat. No. 2,448,145, which discloses a selective application of water to fabric with a noticeably ribbed effect in the filling direction. The fabric is then placed under high tension and then dried. This will distort the filling yarns in the wet areas differently that the filling yarns in the dry areas. Again, upon applying pressure to two pieces of this treated fabric, the moiré pattern is produced. A severe problem with this technology is that it is very difficult to wet yarn selectively while leaving adjacent yarns dry for a very precise pattern. Furthermore, stretching under high tension can severely weaken or even destroy the filling yarns. This method requires fibers to absorb large amounts of water such as cotton, silk, and so forth. Each pattern requires a specific patterning roll or screen which only changes the pick count slightly in the areas treated with water.

Figure 2:
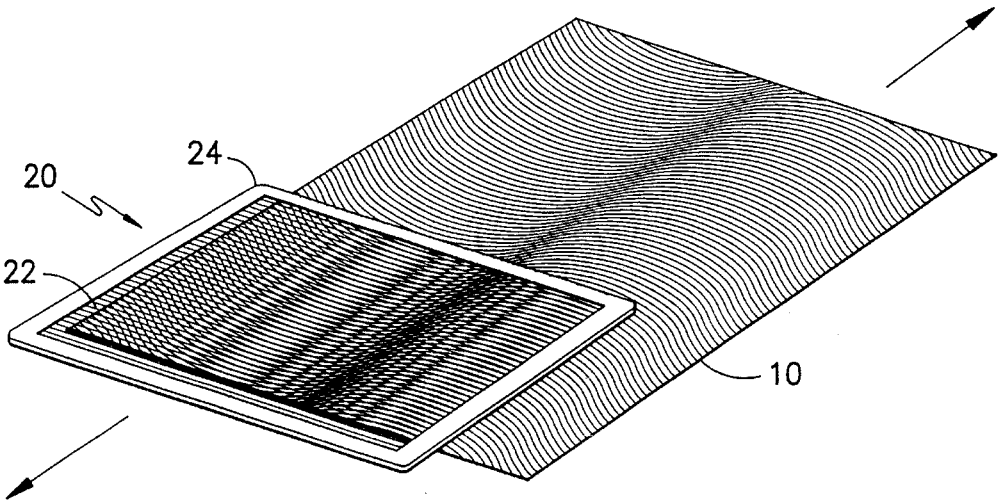
FIG. 2 is a perspective view of the apparatus for simulating the appearance of a moiré pattern as illustrated in FIG. 1 and is positioned over the fabric having filling yarns that are laterally shifted thereby illustrating the simulation of a moiré pattern.

Another method of laterally shifting the filling yarns is to selectively apply pressurized heated gas to the fabric. This results in the melting of the yarn, thereby shifting the filling yarns. This effect may also be accomplished by use of a laser beam. Still another method of creating moiré fabric is the pressurized application of fluid to laterally shift the filling yarns. This again may be done in a very selective patterned arrangement. The above is merely a sampling of some of the many means of treating fabric 10 in which the filling yarns will be laterally shifted, as shown in FIG. 1 and FIG. 2. The viewing screen for optically simulating moiré is generally indicated by numeral 20 in FIG. 1 and FIG. 2. Viewing screen 20 comprises of a substantially transparent sheet 22 that is enclosed in a frame 24. This sheet 22 has a number of lines per inch whereby the lines per inch substantially correspond to the number of picks or filling yarns per inch in fabric 10. Therefore, a one-to-one correspondence between lines on sheet 22 and filling yarns in fabric 10 is desired. The lines on sheet 22 are substantially straight and parallel to the warp yarns in fabric 10.

As shown in FIG. 2, viewing screen 20 will simulate the appearance of a moiré pattern on fabric 10 prior to any application of pressure. Some traditional means of applying pressure include calender rolls, high pressure rotary presses and platen presses. Moiré patterns are defined as wavy or water effects. Traditionally this is a corded fabric of silk, rayon or one of the manufactured fibers. An excellent example of a corded fabric would be a faille. Failles are generally defined as having fine, bright, continuous filament yarns, course spun filling and a plain weave. This creates a noticeable ribbed effect in the filling direction. Other fabrics can be utilized with typically lesser results, however, a visibly ribbed effect should be present in the fabric's filling.

Sheet 22 should be substantially transparent and may be manufactured out of any of a wide variety of materials including plastic, acetate, polyester, glass, and so forth. The preferred substance would be a thin sheet of polyester which is very durable and may be printed by a computer printer for extremely fine, detailed resolution. Virtually any type of marking means can be utilized to create the lines. The frame 24 is optional and may be made of any wide variety of substantially hard substances such as plastics, metals, composites, and so forth. This moiré pattern viewing screen 20 can provide an individual with a very detailed reproduction of how the final moiré fabric will look prior to the application of pressure. This may prove to be a considerable advantage in eliminating waste and will prove helpful in the design of moiré fabrics.

Figure 3:
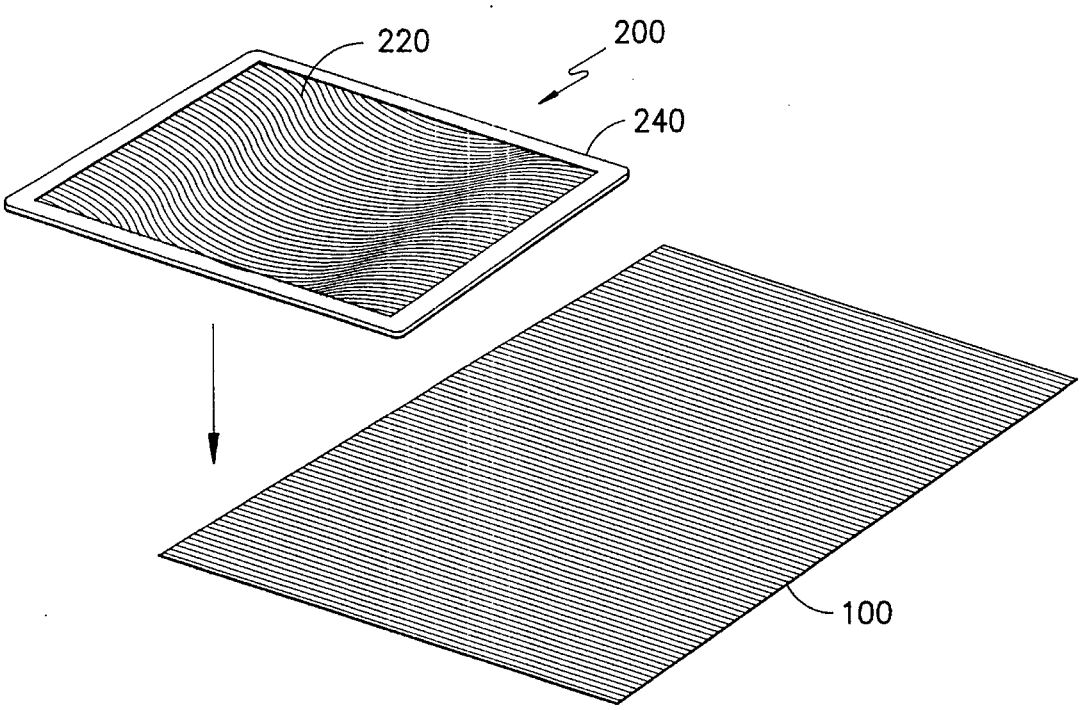
FIG. 3 is a perspective view of an apparatus to simulate the appearance of a moiré pattern in conjunction with an untreated piece of fabric having filling yarns that are not laterally shifted.
Figure 4:
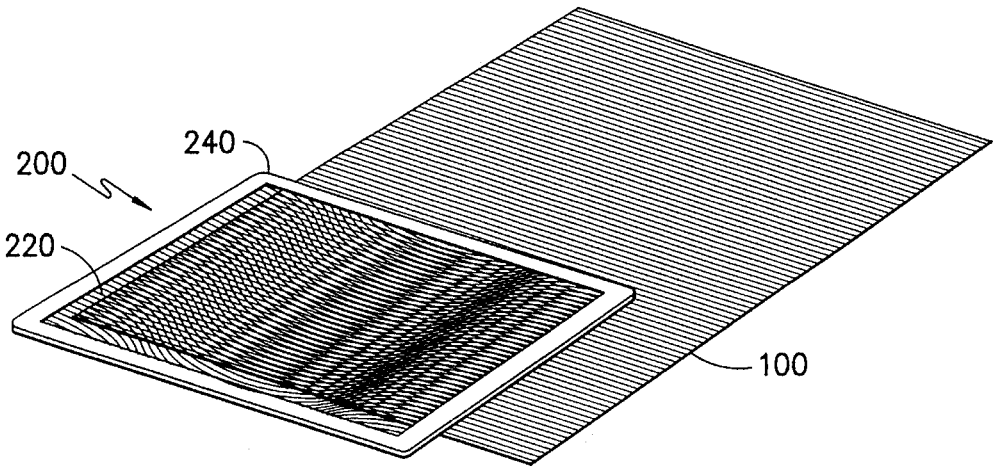
FIG. 4 is a perspective view of the apparatus for simulating the appearance of a moiré pattern as illustrated in FIG. 3 and is positioned over the untreated fabric having filling yarns that are not laterally shifted thereby illustrating the simulation of a moiré pattern.

Another embodiment of a viewing screen to simulate a moiré pattern fabric 20 is that shown in FIGS. 3 and 4 and is generally denoted by a numeral 200. This could be construed as a preferred embodiment since the substantially transparent sheet 220, although having the same number of lines per inch as filling yarns in fabric 100, utilizes curved lines which represent the potential lateral shifting of the filling yarns. Therefore, when utilizing untreated fabric 100, you can simulate a final moiré pattern prior to performing any process whatsoever on the fabric 100. This can provide a considerable cost savings as well as lessen development costs to a significant degree. This viewing screen 200 also has an optional frame 240 which is similar to the frame 24 shown in FIGS. 1 and 2.

As shown in FIG. 4, viewing screen 200 will simulate the final appearance of the moiré pattern on plain, untreated fabric 100 without having to shift the filling yarn or subject the fabric 100 to pressure. This, therefore, provides a very significant commercial advantage. Again, the curved lines of sheet 220 should be aligned substantially parallel to the warp yarns in the fabric 100.

Most fiber types will work with this invention including, but not limited to, polyester, polyamide, acetate, rayon, cotton, and so forth. This invention is not restricted to plain weaves, but most woven fabrics will work including, but not limited to, dobby and jacquard woven fabrics. Woven fabrics have warp yarns extending the warp direction and fill yarns extending the fill direction. For best results, the fill yarn should have a ribbed effect. Furthermore, this invention is not restricted to woven fabric since a moiré pattern can be applied to warp knit fabrics. Warp knit fabrics have wales which are a column of loops lying lengthwise in the fabric and correspond to the warp in woven fabrics. Also, warp knit fabric have courses which are a row of loops or stitches running across a knit fabric corresponding to filling in the woven fabrics.

Please keep in mind that the viewing screens 20 and 200 as shown in FIGS. 1, 2, 3, and 4 should be substantially transparent, however, they may be any of a variety of colors, without significantly impacting on the performance of the invention and viewing screens 20 and 200, under any circumstances, do not need to be completely transparent.

As this invention may be embodied in several forms without departing from the spirit or essential character thereof, the embodiments presented herein are intended to be illustrative and not descriptive. The scope of the invention is intended to be defined by the following dependent claims, rather than any descriptive matter herein above, and all embodiments of the invention which fall within the meaning and range of equivalency of such claims are, therefore, intended to be embraced by such claims.

What is claimed is:

1. An apparatus for simulating an appearance of a moiré fabric on a textile fabric having a number of filling yarns per inch comprising of a substantially transparent sheet having a number of lines per inch across said substantially transparent sheet wherein said lines per inch are in a substantially one-to-one correspondence to said filling yarns per inch in said textile fabric to be viewed and when said lines are aligned substantially parallel to said filling yarns, the appearance of a moiré fabric is simulated.

2. An apparatus for simulating an appearance of a moiré fabric on a textile fabric as defined in claim 1, wherein said lines are substantially straight.

3. An apparatus for simulating an appearance of a moiré fabric on a textile fabric as defined in claim 1, wherein said lines are substantially curved.

4. An apparatus for simulating an appearance of a moiré fabric on a textile fabric as defined in claim 1, wherein said substantially transparent sheet is a plastic film.

5. An apparatus for simulating an appearance of a moiré fabric on a textile fabric as defined in claim 1, wherein said substantially transparent sheet is an acetate film.

6. An apparatus for simulating an appearance of a moiré fabric on a textile fabric as defined in claim 1, wherein said substantially transparent sheet is a polyester film.

7. An apparatus for simulating an appearance of a moiré fabric on a textile fabric as defined in claim 1, wherein said substantially transparent sheet is a glass plate.

8. A process for simulating an appearance of a moiré pattern on textile fabric having a number of laterally shifted filling yarns per inch, comprising the steps of:

(a) placing a substantially transparent sheet having a number of lines per inch across said substantially transparent sheet in overlapping relation to a piece of textile fabric having a substantially corresponding number of filling yarns per inch; and (b) aligning said lines of said substantially transparent sheet in substantially parallel relationship to said filling yarns of said piece of textile fabric thereby simulating the appearance of a moiré pattern.

9. A process for simulating an appearance of a moiré pattern on textile fabric having a number of laterally shifted filling yarns per inch comprising the steps of:

(a) placing a substantially transparent sheet having a number of straight lines per inch across said substantially transparent sheet in overlapping relation to a piece of textile fabric having a substantially corresponding number of filling yarns per inch which have been laterally shifted; and (b) aligning said straight lines of said substantially transparent sheet in substantially parallel relationship to said filling yarns of said piece of textile fabric thereby simulating the appearance of a moiré pattern.

10. A process for simulating an appearance of a moiré pattern on textile fabric having a number of filling yarns per inch comprising the steps of:

(a) placing a substantially transparent sheet having a number of curved lines per inch across said substantially transparent sheet in overlapping relation to a piece of textile fabric having a substantially corresponding number of filling yarns per inch; and (b) aligning said curved lines of said substantially transparent sheet in substantially parallel relationship to said filling yarns of said piece of textile fabric thereby simulating the appearance of a moiré pattern.

* * * * *